US009561948B2

(12) United States Patent
Fahnle et al.

(10) Patent No.: US 9,561,948 B2
(45) Date of Patent: Feb. 7, 2017

(54) MULTIFUNCTIONAL MODULE FOR A REFRIGERATING APPARATUS

(71) Applicant: BSH BOSCH UND SIEMENS HAUSGERATE GMBH, Munich (DE)

(72) Inventors: Elmar Fahnle, Elchingen (DE); Eugen Gaplikow, Gunzberg (DE); Hans Gerd Keller, Giengen (DE); Michael Krapp, Nattheim (DE); Karl-Friedrich Laible, Langenau (DE); Vitaliy Rimkevich, Giengen (DE); Hans Peter Werner, Giengen (DE)

(73) Assignee: BSH HAUSGERÄTE GMBH, Munich (DE)

( * ) Notice: Subject to any disclaimer, the term of this patent is extended or adjusted under 35 U.S.C. 154(b) by 299 days.

(21) Appl. No.: 14/219,616

(22) Filed: Mar. 19, 2014

(65) Prior Publication Data

US 2015/0027153 A1 Jan. 29, 2015

(30) Foreign Application Priority Data

Jul. 29, 2013 (DE) ..... 20 2013 006 815 U

(51) Int. Cl.
*F25D 3/00* (2006.01)
*B67D 3/00* (2006.01)
*F25D 23/12* (2006.01)

(52) U.S. Cl.
CPC ..... *B67D 3/0009* (2013.01); *F25D 23/126* (2013.01)

(58) Field of Classification Search
CPC ..... F25D 23/126; F25D 31/002; B67D 1/0867
USPC ..... 62/389, 390, 391
See application file for complete search history.

(56) References Cited

U.S. PATENT DOCUMENTS 2,183,509 A * 12/1939 Smith ..... F25D 31/002 165/118
5,419,150 A * 5/1995 Kaiser ..... A23G 9/16 62/342
7,552,593 B2 * 6/2009 Smith ..... B67D 1/0864 62/389
2006/0027267 A1 2/2006 Fritze

FOREIGN PATENT DOCUMENTS

DE 8010288 8/1984
DE 4209582 9/1993
DE 11 2006 000 552 3/2008

OTHER PUBLICATIONS

Search Report issued in corresponding Turkish Patent Application No. 2014/03572 completed on Jan. 19, 2015.

* cited by examiner

*Primary Examiner* — Melvin Jones
(74) *Attorney, Agent, or Firm* — Nixon & Vanderhye P.C.

(57) ABSTRACT

A multifunctional module for a refrigerating apparatus with a module housing, includes a controllable function valve arranged for dispensing water from a water circuit. The module housing includes a leak detection device for detecting water leakage inside the module housing.

17 Claims, 3 Drawing Sheets

MULTIFUNCTIONAL MODULE FOR A REFRIGERATING APPARATUS

Figure 1:
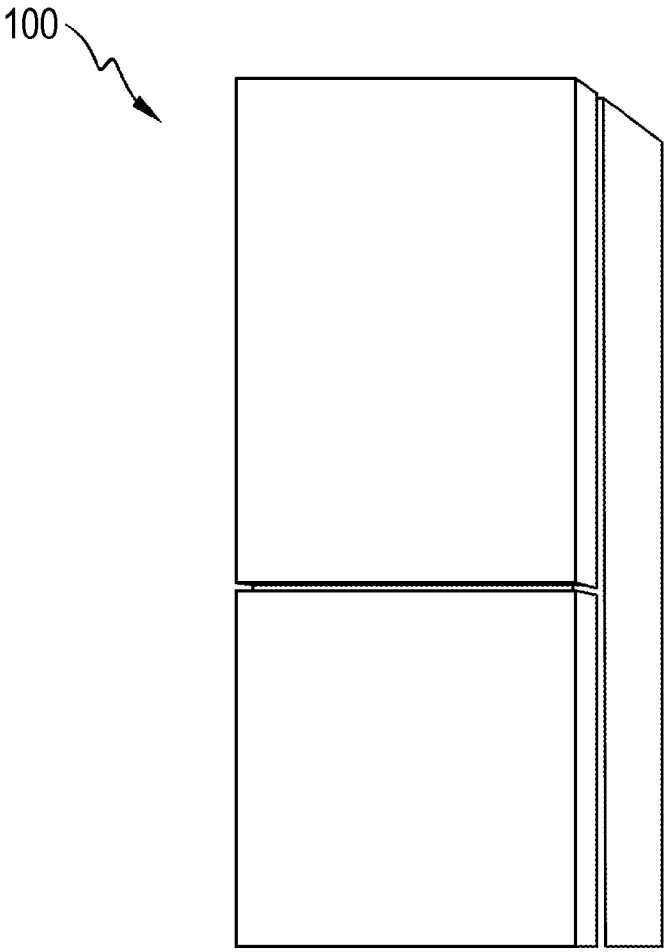

This application claims priority to DE Patent Application No. 20 2013 006 815.9 filed 29 Jul. 2013, the entire content of which is hereby incorporated by reference.

The present invention relates to a multifunctional module for a refrigerating apparatus with a module housing, in which a controllable function valve for dispensing water from a water circuit is arranged.

The document DE 11 2006 000 552 T5 describes a cooling apparatus having a liquid supply system for a user apparatus with a protection system to prevent an overflow stemming from any leakage of liquid.

It is the object of the invention to provide a compact, multifunctional module which prevents escape of water in a water-conducting refrigerating apparatus.

This object is achieved by the article with one or more features described herein. Advantageous embodiments of the invention are the subject of the figures, and the description.

According to one aspect of the invention, the object is achieved by a multifunctional module for a refrigerating apparatus with a module housing, in which a controllable function valve for dispensing water from a water circuit is arranged, in which the module housing comprises a leak detection device for detecting water leakage inside the module housing. In addition, the module housing comprises a vent for venting the multifunctional module. The multifunctional module has the technical advantage, for example, that a compact unit is formed inside the refrigerating apparatus with which the loss of water can be prevented (aquastop function). The function valve is protected from damage by the module housing. In addition, other functional components can be provided in the multifunctional module.

A refrigerating apparatus is understood to mean, in particular, a domestic refrigerating apparatus, hence a refrigerating apparatus which is used for housekeeping in households or in the catering sector, and in particular serves to store food and/or beverages at certain temperatures, such as, for example, a refrigerator, an upright freezer, a fridge freezer, a chest freezer or a wine refrigerator.

In an advantageous embodiment of the multifunctional module, the leak detection device comprises a float for detecting the level of water leakage inside the module housing. A technical advantage of this, for example, is that the level of water leakage can be reliably detected mechanically.

In a further advantageous embodiment of the multifunctional module, the float is connected to a microswitch for interrupting an electrical line. This has the technical advantage, for example, of preventing a short circuit and enabling the level of water leakage to be detected using a smooth-running electromechanical device.

In an advantageous embodiment of the multifunctional module, the microswitch is arranged above the float. This has the technical advantage, for example, of preventing damage to the microswitch by water.

In an advantageous embodiment of the multifunctional module, the module housing comprises a collecting tray for collecting water leakage. This has the technical advantage, for example, that water leakage is collected in the collecting tray and an escape of water is prevented.

In an advantageous embodiment of the multifunctional module, the collecting tray comprises an overflow. This has the technical advantage, for example, of preventing uncontrolled overflowing of the collecting tray.

In an advantageous embodiment of the multifunctional module, the collecting tray is arranged below the function valve. This has the technical advantage, for example, of collecting water which leaks from the function valve.

In an advantageous embodiment of the multifunctional module, the function valve is designed to close off an output of water when a power supply is interrupted. This has the technical advantage, for example, that the function valve also closes reliably without an external energy supply.

In an advantageous embodiment of the multifunctional module, the lower part of the module housing is formed by an evaporation tray. This has the technical advantage, for example, of enabling the slowly escaping water leakage to evaporate.

In an advantageous embodiment of the multifunctional module, the evaporation tray is made of metal. This has the technical advantage, for example, of increasing heat transfer and evaporation.

In an advantageous embodiment of the multifunctional module, the module housing comprises a non-return valve for blocking a direction of flow of the water circuit. This has the technical advantage, for example, of preventing accidental escape or reverse flow of water from the water circuit.

In an advantageous embodiment of the multifunctional module, the non-return valve is arranged on an outlet of the function valve. This has the technical advantage, for example, of preventing the reverse flow of water into the function valve.

In an advantageous embodiment of the multifunctional module, the module housing comprises a connection for an empty conduit. This has the technical advantage, for example, of enabling the empty conduit to be used for the collection of water in the event of a leak and of guiding the water leakage into the multifunctional module so that the occurrence of a leak can be detected there.

In an advantageous embodiment of the multifunctional module, the module housing comprises a plug connection for supplying electrical power for the function valve. This has the technical advantage, for example, of enabling the multifunctional module to be installed quickly and easily during the manufacture of the refrigerating apparatus.

In an advantageous embodiment of the multifunctional module, the module housing is made of plastic. This has the technical advantage, for example, of enabling the module housing to be manufactured efficiently and simply in technical terms.

Exemplary embodiments of the invention are shown in the drawings and explained in more detail hereinafter.

Figure 2:
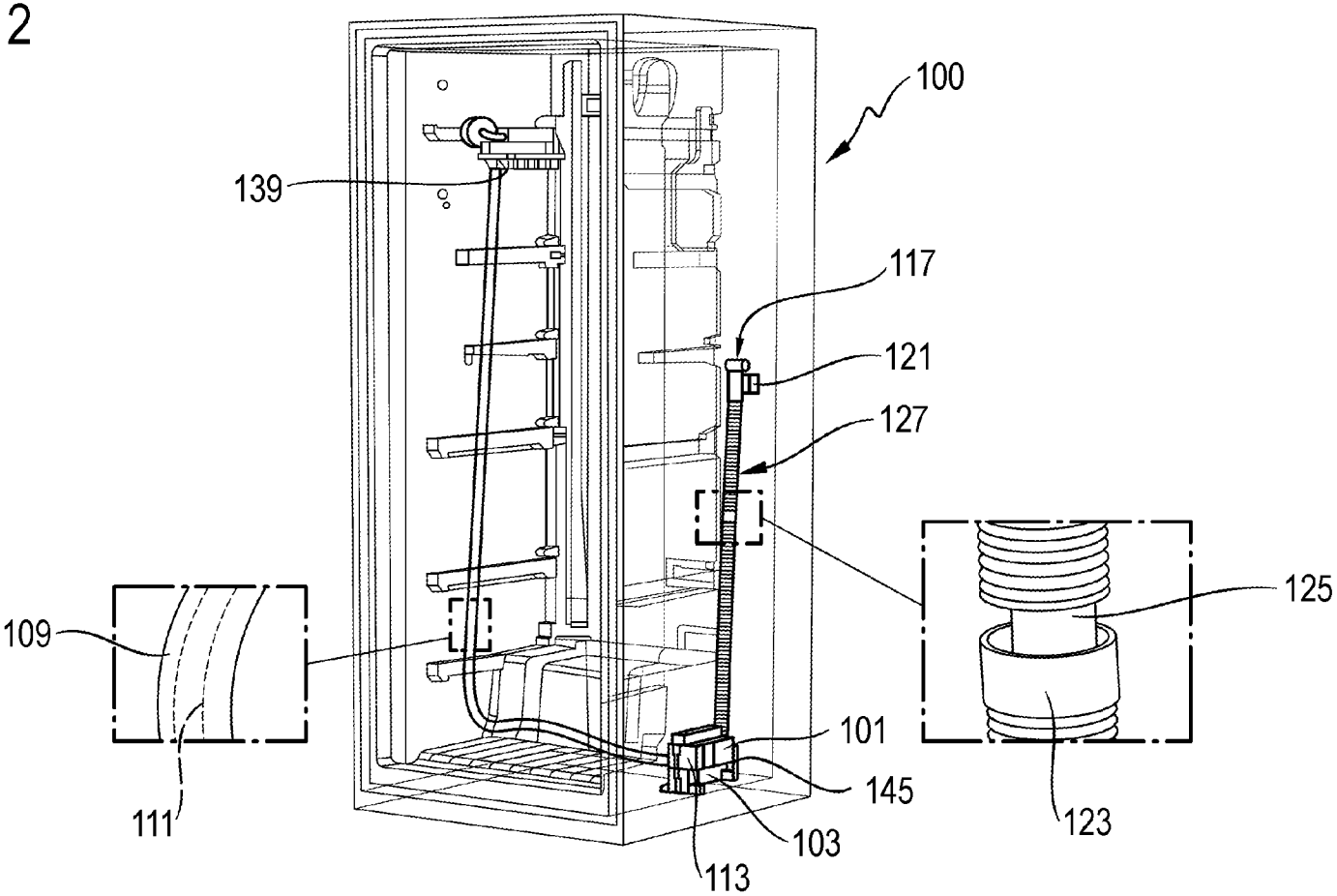

The drawings show:

FIG. 1 a diagrammatic view of a refrigerating apparatus;

FIG. 2 a refrigerating apparatus with a water supply; and

Figure 3:
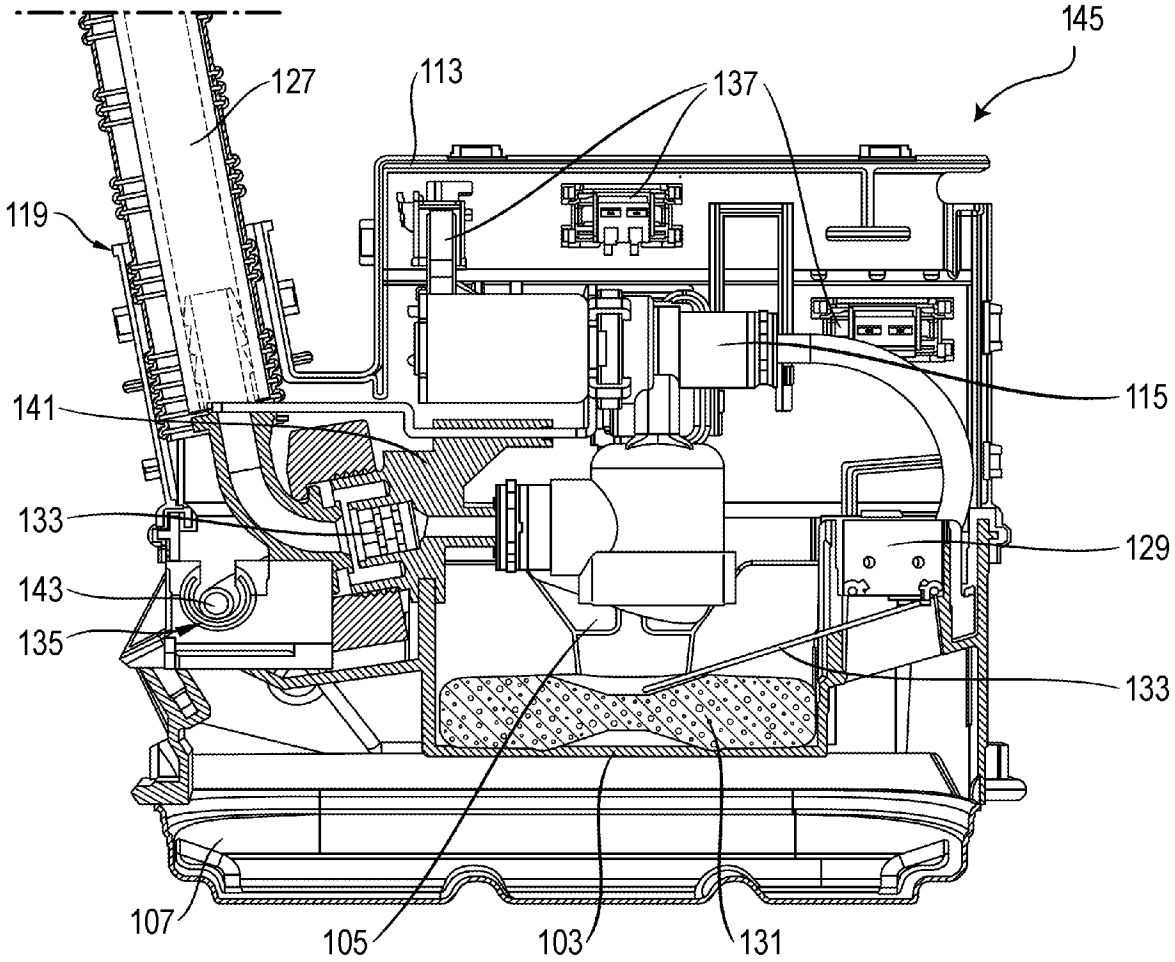

FIG. 3 a set-up of the module housing and additional functional components.

FIG. 1 shows a refrigerator representing a general refrigerating apparatus 100. The refrigerator serves, for example, to cool food and comprises a refrigerating circuit with an evaporator, a compressor, a condenser and a flow control device. The evaporator is a heat exchanger in which after expansion the liquid refrigerant is evaporated by means of heat absorption by the medium to be cooled, i.e. the air inside the refrigerator.

The compressor is a mechanically operated component which removes the refrigerant vapor from the evaporator and discharges it at a higher pressure to the condenser. The condenser is a heat exchanger in which after compression the evaporated refrigerant is condensed by means of heat dissipation to an external cooling medium, i.e. the ambient air. The flow control device is a device for the constant reduction of pressure by means of constriction of the cross-section.

The refrigerant is a fluid which is used for heat transfer in the refrigerant system, which absorbs heat at low temperatures and low pressure of the fluid and emits heat at a higher temperature and higher pressure of the fluid, changes in the state of the fluid customarily being included.

FIG. 2 shows a water supply in the refrigerating apparatus 100, seen from the front of the device. The refrigerating apparatus 100 is connected to an external water supply and is equipped with an automatic ice and/or water output with corresponding water-conducting components. The refrigerating apparatus 100 is connected to an external water supply 117 by an inlet hose 127 which forms an inlet line from the water supply 117. The inlet hose 127 comprises an electric safety valve 121, which is arranged directly on the water supply 117 and is controlled by the refrigerating apparatus 100. The safety valve 121 is located at the beginning of the inlet hose 127.

The safety valve 121 serves as a water valve in the water circuit of the refrigerating apparatus 100 and shuts off the line pressure on the external water supply 117 so that the subsequent water circuit inside the refrigerating apparatus 100 is depressurized.

The inlet hose 127 comprises an inner hose 125 which supplies the water from the water supply 117 to the refrigerating apparatus 100 and an outer hose 123 which surrounds the inner hose 125 and takes any water leakage from the inner hose 125 or the safety valve 121 and its joints to a collecting tray 103. The inlet hose 127 is connected to a multifunctional module 145 with a box-shaped module housing 113 which is arranged inside the refrigerating apparatus 100 and comprises a leak detection device 101. A water conduit 111 leads from the function valve and the module housing 113 to an automatic ice maker 139 and/or to another water output.

The collecting tray 103 for the water leakage is incorporated into the module housing 113. The module housing 113 simultaneously serves as housing for mounting a function valve and for the components which are responsible for leakage detection. Leakage points inside the refrigerating apparatus 100 may occur in particular at joints or connection points of different water-conducting components.

The elastic water conduit 111 is fed through an empty conduit 109 to the hose routing, which is laid in the insulating foam of the refrigerating apparatus 100. The empty conduit 109 serves for ease of hose installation. Furthermore, the empty conduit 109 serves to remove the water leakage which may occur in the course of the water conduit 111 and its joints with other components. To this end, the empty conduits 109 are connected to the module housing 113 in such a way that the water leakage is fed into the collecting tray 103 inside the module housing 113. In particular, the connection points and transitions of various water-conducting components can be protected from water loss by surrounding empty conduits 109.

FIG. 3 shows a design of the multifunctional module 145 and other functional components. The refrigerating apparatus 100 comprises the safety valve 121 on the water supply 117 and the function valve 115 inside the refrigerating apparatus 100. The function valve 115 enables a regulated flow of water for the output of water from the water circuit. The safety valve 115 is a valve without a flow control device to fully open or close off the water supply.

The safety valve 121 and the function valve 115 are connected in series. The function valve 115 is arranged in the direction of the flow of water in the water circuit after the safety valve 121. Even if one of the two valves should no longer be able to close off a water supply on account of a malfunction, in this case the water supply can be closed off by the other of the two valves. Even in the case of a temporarily dripping valve, the water supply can therefore be fully closed off.

Both the safety valve 121 and the function valve 115 can be electrically switched by a control device. Both simultaneous and delayed activation and deactivation of the valves is possible by means of the electronic control of the valves.

The water-conducting components and their water supplies are arranged in the module housing 113 of the multifunctional module 145 such that any water leakage which may occur is collected in the collecting tray 103. The collecting tray 103 comprises an overflow 105 for collected water leakage. The overflow 105 serves on the one hand to protect the electrical components from increasing water leakage and on the other hand to remove the excess water leakage.

The collecting tray 103 is arranged above an evaporation tray 107 to collect this excess water leakage. The actual purpose of the evaporation tray 107 is to collect defrosting water from the refrigerating apparatus 100. The arrangement of the collecting tray 103 above the evaporation tray 107 produces an additional collection volume for water leakage, meaning that the design of the module housing 113 of the multifunctional module 145 itself can be as compact as possible. The module housing 145 comprises, for example, a molded plastic component.

The water leakage is fed to the collecting tray 103 as part of the leak detection device 101. A float 131 is arranged there which floats as a result of the increasing water leakage and activates a microswitch 129 via a switch lever 133. The collecting tray 103 inside the module housing 113 has a small collection volume for water leakage. Only a small volume of water is therefore necessary to activate the microswitch 129 by means of the float 131 in the event of a leak. This has the advantage of enabling a leak to be reliably detected even with small volumes of leaking water. If more water flows from the leak, this is transferred to the evaporation tray 107 with a larger collection volume in a controlled manner via the overflow 105. The collecting tray 103 is arranged above the evaporation tray 107 so that water flows into the evaporation tray 107 from the overflow 105 due to gravity. For this purpose, the overflow 105 can be connected to the evaporation tray 107 by means of a hose.

As a result, both detection of the leak by means of small volumes of water leakage as well as escape of the leaked water is prevented. In addition, on account of the small collection volume of the collecting tray 103, the module housing 117 can be produced in a compact version.

The microswitch 129 is integrated into the electric circuit of the safety valve 121 in such a way that it interrupts the power supply to the safety valve 121. The power supply is provided, for example, by mains electricity. This ensures that in the event of a leak, the safety valve 121 is mechanically separated from the power supply line. Power lines and the line connectors inside the refrigerating apparatus 100 are arranged spatially in such a way that they cannot come into contact with water. To this end, water-conducting components and possible leakage points are arranged beneath the electrical power lines and plugs.

As a result, the safety valve 121 is closed in the event of a leak and the flow of water to the refrigerating apparatus 100 is interrupted at the connection point to the water supply. The activated microswitch 129 emits a signal to a control device so that a power supply to the function valve 115 is also interrupted via the control device. When the power supply is interrupted, both the function valve 115 and the safety valve 121 are in a closed position. If the power supply is interrupted, the valves therefore close automatically. Direct interruption of the power supply provides the most secure form of mechanical deactivation. If water leakage is detected by the leak detection device 101 using the microswitch 129, a visible or audible alarm is emitted on the control panel of the refrigerating apparatus 100.

In addition, a non-return valve 133 is installed between the safety valve 121 and the function valve 115 in the module housing 113 of the multifunctional module 145. The non-return valve 133 prevents an uncontrolled outflow of water from the water circuit of the refrigerating apparatus, for example, when the refrigerating apparatus 100 is disconnected from an external water supply during dismantling. In addition, the non-return valve 133 prevents the water in the refrigerating apparatus 100 from flowing back into the domestic water supply. By using the non-return valve 133 inside the water circuit, this can be achieved in a particularly reliable manner which also saves space. Unlike other domestic appliances, such as dishwashers for example, which use a free-flowing section, the use of the non-return valve 133 in the water circuit of the refrigerating apparatus 100 is possible without any problems, as the water in the water circuit of the refrigerating apparatus 100 does not contain any residual dirt and is of a high quality.

The laying of water conduits 111 in the refrigerating apparatus 100 takes place via the empty conduits 109, in which hoses are guided. These empty conduits 109 are used to transport the water leakage from the water-conducting components to the collecting tray 103. To this end, the module housing 113 of the multifunctional module 145 comprises an empty conduit connection 135 with a hose outlet 143. The inlet hose 127 from the safety valve 121 is connected to the module housing 113 at a connection 119 with a hose inlet.

The collecting tray 103 comprises the overflow 105, which is directly above an evaporation tray 107. The function valve 115 is mechanically connected to the non-return valve 133 via a connecting part 141. In addition, the module housing 113 of the multifunctional module 145 comprises several plug connections 137 for supplying the leak detection device with electrical power. The plug connections 137 serve to supply electrical power or to transmit control signals. A first plug connection 137 is, for example, provided to supply energy to the function valve 115, a second plug connection 137 is, for example, provided to transmit electrical signals from the microswitch 129 and a third plug connection 137 is provided to connect a control line for the safety valve 121.

In further embodiments the non-return valve 133 may be positioned between the safety valve 121 and the water supply 117. The inlet hose 127 may be connected directly to the safety valve 121 without a joint. The function valve 115 may be directly integrated in the inlet hose 127 behind the safety valve 121.

The exemplified system may be used in all refrigerating apparatuses such as, for example, refrigerators, freezers or combined devices. The system prevents damage as a result of water leakage from water-conducting components and their joints. A direct arrangement of the safety valve 121 on the water supply 117 facilitates a depressurized water system inside the refrigerating apparatus 100, if no water is required by the refrigerating apparatus 100. The functional reliability of the water circuit is increased by combining the safety valve 121 and the function valve 115. The empty conduits 109 in the insulating foam of the refrigerating apparatus 100 serve not only to guide water conduits and hoses, but also to remove water leakage. The safety valve 121 and/or the function valve 115 may be constituted by a solenoid valve.

The multifunctional module 145 may be realized in a compact manner by means of the overflow 105 for water leakage from the collecting tray 103 into the evaporation tray 107. The evaporation tray 107 may form part of the module housing 113. In addition, the evaporation tray 107 may consist of a thermally conductive material such as metal or sheet metal so that the transfer of heat to the evaporation tray 107 is improved and evaporation is increased.

All the features explained and shown in connection with individual embodiments of the invention may be provided in different combinations in the article according to the invention in order to realize their advantageous effects simultaneously.

The scope of protection of the present invention is defined by the claims and is not restricted by the features explained in the description or shown in the figures.

LIST OF REFERENCE CHARACTERS

100 Refrigerating apparatus
101 Leak detection device
103 Collecting tray
105 Overflow
107 Evaporation tray
109 Empty conduit
111 Water conduit
113 Module housing
115 Function valve
117 Water supply
119 Connection
121 Safety valve
123 Outer hose
125 Inner hose
127 Inlet hose/inlet line
129 Microswitch
131 Float
133 Non-return valve
135 Empty conduit connection
137 Plug connection
139 Ice maker
141 Joint
143 Hose outlet
145 Multifunctional module

The invention claimed is:

1. A multifunctional module for a refrigerating apparatus with a module housing, in which a controllable function valve is arranged for dispensing water from a water circuit, wherein the module housing comprises a leak detection device for detecting water leakage inside the module housing, and the module housing comprises a collecting tray to collect water leakage within the module housing in a manner that protects against water damage to the function valve.

2. The multifunctional module as claimed in claim 1, wherein the leak detection device comprises a float for detecting the level of water leakage inside the module housing.

3. The multifunctional module as claimed in claim 2, wherein the float is connected to a microswitch for interrupting an electrical line.

4. The multifunctional module as claimed in claim 3, wherein the microswitch is arranged above the float.

5. The multifunctional module as claimed in claim 1, wherein the collecting tray comprises an overflow.

6. The multifunctional module as claimed in claim 1, wherein the collecting tray is arranged below the function valve.

7. The multifunctional module as claimed in claim 1, wherein the function valve is designed to close off an output of water when a power supply is interrupted.

8. The multifunctional module as claimed in claim 1, wherein the lower part of the module housing is formed by an evaporation tray.

9. The multifunctional module as claimed in claim 8, wherein the evaporation tray is made of metal.

10. The multifunctional module as claimed in claim 1, wherein the module housing comprises a non-return valve for blocking a direction of flow of the water circuit.

11. The multifunctional module as claimed in claim 10, wherein the non-return valve is arranged on an outlet of the function valve.

12. The multifunctional module as claimed in claim 1, wherein the module housing comprises a connection for an empty conduit.

13. The multifunctional module as claimed in claim 1, wherein the module housing comprises a plug connection for supplying electrical power for the function valve.

14. The multifunctional module as claimed in claim 1, wherein the module housing is made of plastic.

15. A domestic appliance with a multifunctional module as claimed in claim 1.

16. A domestic appliance as claimed in claim 1, wherein the module includes:

an inlet hose connection for connecting to an inlet hose; and an outlet hose connection for connecting to a water conduit that provides water to a water output of the refrigerating apparatus; and an overflow associated with the collecting tray.

17. A domestic appliance as claimed in claim 16, further comprising and evaporation tray formed as part of the module housing, the evaporation tray being in fluid communication with the overflow.

* * * * *